US005736718A

United States Patent [19]

Levinson

[11] Patent Number: 5,736,718

[45] Date of Patent: Apr. 7, 1998

[54] MICROWAVE OVEN, COOKING KIT AND METHODS FOR ITS USE

[76] Inventor: Melvin L. Levinson, 8 Stratford Cir., Edison, N.J. 08820-1830

[21] Appl. No.: 422,942

[22] Filed: Apr. 17, 1995

[51] Int. Cl.[6] ..... H05B 6/80

[52] U.S. Cl. ..... 219/729; 219/730; 219/732; 219/733; 426/243; 99/DIG. 14; 99/397; 99/444

[58] Field of Search ..... 219/730, 732, 219/729, 733; 426/241, 234, 243; 99/394, 397, 400, 425, 427, 444, 445, 446, DIG. 14

[56] References Cited

U.S. PATENT DOCUMENTS

| | | | |
|---|---|---|---|
| 1,201,704 | 10/1916 | Davite | 99/397 |
| 3,985,990 | 10/1976 | Levinson . | |
| 4,015,085 | 3/1977 | Woods | 219/729 |
| 4,074,102 | 2/1978 | Asen . | |
| 4,112,833 | 9/1978 | Oda . | |
| 4,214,515 | 7/1980 | Kubiatowicz . | |
| 4,450,334 | 5/1984 | Bowen et al. . | |
| 4,454,403 | 6/1984 | Teich et al. | 219/730 |
| 4,748,308 | 5/1988 | Drews | 219/730 |
| 4,773,316 | 9/1988 | Dougherty | 99/397 |
| 4,862,791 | 9/1989 | Baughey | 99/444 |
| 4,887,523 | 12/1989 | Murphey et al. . | |
| 4,906,806 | 3/1990 | Levinson . | |
| 4,923,704 | 5/1990 | Levinson . | |
| 5,045,660 | 9/1991 | Levinson . | |
| 5,057,381 | 10/1991 | Levinson . | |
| 5,075,526 | 12/1991 | Sklenak et al. | 219/730 |
| 5,094,865 | 3/1992 | Levinson . | |
| 5,236,727 | 8/1993 | Huston | 426/138 |
| 5,288,962 | 2/1994 | Lorence et al. | 219/729 |

*Primary Examiner*—Philip H. Leung

[57] ABSTRACT

A microwave-oven, cooking kit to brown, edge-heat and remove fat from meat and to crust bread that includes: (1) one or more flat metal plates, (2) two microwave-oven browning grills, (3) a by-product collection chamber and (3) apparatus to secure, manipulate, compress together and transport these members. These cooking members may be employed individually or in various combinations. The two microwave-oven browning grills are designed to be employed vertically and horizontally. In operation, when vertical, melted fat and other liquid by-products are removed by gravity and compression.

9 Claims, 5 Drawing Sheets

MICROWAVE OVEN, COOKING KIT AND METHODS FOR ITS USE

BACKGROUND OF THE INVENTION

1. Field of the Invention

The present invention concerns a microwave-oven, cooking kit to brown, edge-heat and remove fat from meat and to crest bread.

2. Discussion of the Prior Art

Microwave ovens have been criticized for their inability to reconstitute frozen or packaged bread. Undesirably, exposed to microwave energy, bread spot heats and, after exposure, dries rapidly.

Fat in meat melts when hamburgers, sausages and the like are exposed to microwave energy. Steam produced, within the hamburgers, sausages and the like, drives some of the melted fat out of these foods. For those, who, on restricted fat diets, wish to partake of a low fat hamburger or sausage sandwich, exposing meat to microwave energy does not remove enough fat from the cooked meat. People, on low fat diets, partake of low fat "vegetable hamburger" sandwiches in place of a low-fat hamburger or low fat sausage sandwich that, if available, they would prefer.

This cooking kit improves on the "Invertible, Microwave Oven Apparatus" taught in U.S. Pat. No. 5,045,660. This prior art microwave oven apparatus concerns two opposing microwave-absorptive heating members and a chamber foxing member. The cooking chamber of this prior art apparatus is intended to be invertible and operates with its food contacting surfaces parallel to the oven floor. This U.S. Pat. No. 5,045,660 teaches that the upper heating member does not contact the upper surface of the food. When not in contact with food, the upper heating element is free to rise to browning temperatures. This patent teaches to invert the apparatus to permit the former lower heating members to empty and, as the new upper member to rise, when exposed to microwave energy, to browning temperatures. This patent teaches that, during inversion, the apparatus can be held in its vertical position to drain unwanted liquid by-products from its cooking chamber.

Microwave toasted-cheese-sandwich makers, waffle irons, and hamburger grills are known. These microwave-oven, toasted-cheese sandwich, waffle and hamburger makers employ microwave-lossy heating members that are designed to brown the surfaces of food that their heating elements contact. The weight of the uppermost heating member compresses, by gravity, a food cooking thereunder.

Prior art apparatus, as Northland Aluminum Co.'s "Microwave Hamburger Grill," exert a fixed pressure on a cooking food until further compression, of the opposing heating members, is prevented by walls that form the cooking chamber. U.S. Pat. No. 4,450,334, teaches to employ a microwave reflective cover on a microwave-lossy heating grill.

U.S. Pat. No. 3,985,990 teaches to collect and shield from microwave energy, liquid byproducts of a cooking food. U.S. Pat. Nos. 4,906,806 and 4,923,704 teach to brown a food under a microwave-lossy heating grill and to employ the fixed weight of the grill to exert downward pressure on the food. This downward pressure forces liquid by-produced out of the food into a chamber that collects and shields these liquid by-products from further exposure to microwave energy. To produce warm, moist bread, it is known to spray water on dry bread, prior to exposing it to microwave energy.

It is well known, in both microwave and conventional cooking, to cook food while it is supported vertically. For example, supporting food vertically during cooking is taught in U.S. Pat. Nos. 4,074,102, 4,214,515, 4,887,523, 4,112,833, and 5,057,331.

STATEMENT OF THE PRESENT INVENTION

The present invention describes a microwave-oven cooking kit that comprises: (1) one or more flat metal plates, (2) two microwave-oven browning grills, (3) a by-product collection chamber and (3) apparatus to secure, manipulate, compress together and transport these members. These cooking members may be employed individually or in various combinations.

The kit of the present invention is designed to be employed vertically and horizontally. In operation, in its vertical position, melted fat and other liquid by-products are removed by gravity and compression.

The kit is designed to enhance the toasting and crusting of bread slices, rolls and the like. The non-lossy members of the kit can be employed to shield from microwave energy the inside dough and aides in the crusting of the peripheral surface of a flat foodstuff, as a slice of bread. The lossy members of the kit can be employed to toast the flat surfaces and edge heat the peripheral surface of a flat foodstuff, as a slice of bread. Preferably, this apparatus is employed to microwave, defrost, heat and crust slices of previously baked bread.

In the present invention, a flat foodstuff is placed between two, flat, metal plates and exposed to microwave energy to enhance the end heating of the exposed periphery of the flat foodstuff and for controlling the amount of moisture remaining in a flat foodstuff after it has been exposed to microwave energy.

The kit is designed to provide low fat hamburgers, low-fat sausage, and the like. When exposed to microwave energy, member of this kit are designed to edge-heat and to brown, crust and remove fat from meat. Concurrently or sequentially with preparing this low fat meat, the kit is designed to defrost, heat and crust bread slices. These two operation combine to prepare low fat meat sandwiches.

According to the present invention invertible, microwave-oven cooking members are provided that include: a first microwave-absorptive heating member that has a first cooking surface fabricated to heat a food in contact therewith; a second microwave-absorptive heating member that has a second cooking surface fabricated to heat a food in contact therewith; and apparatus to secure and manipulate the heating members. The apparatus, that secures and manipulates the heating members, can be employed to squeeze the two microwave-absorptive heating members toward each other and so compress a food there between.

The apparatus that presses the two microwave-absorptive heating members toward each other may be conventional cooking tongs or a specially designed apparatus as an elastic by-product container. The pressing means is designed to engage the microwave heated plates so that they may be securely removed from the microwave oven and returned to the microwave oven either in this original orientation or inverted. When the two microwave-absorptive heating members are held in a vertical orientation, the pressing means may be employed to press the two vertical, microwave-absorptive, heating members toward each other to squeeze liquid by-products out of a food located between the two microwave lossy It is an object of this invention to obtain the cooking results of broiling, barbecuing, crusting, fat removal, frying, searing and toasting using the kit described.

When not employed vertically to squeeze fat out of a food, the dual heating member can be employed in a conventional manner. As taught in U.S. Pat. No. 5,094,865, the heating members can be used to cook a variety of foods, for example, pies, cakes, rolls, French fried potatoes, spare ribs, pancakes, toasted cheese sandwiches and the like.

The two microwave-lossy members can be used for other novel cooking purposes. For example, they can be employed to sandwich a raw, frozen pie in its aluminum foil container. Then the assembly is heated until the pie's top and bottom crust start to brown. Whereupon, the top heating member is removed and the pie, in its aluminum container, resting on the bottom heating member is exposed again to microwave energy until it completely bakes.

DESCRIPTION OF THE DRAWINGS

The advantages and benefits, resulting from employing the members of the described microwave-oven cooking kit, individually and in various combinations and orientations, will become apparent, from the following detailed description, by reference to the accompanying drawings, in that.

DESCRIPTION OF THE PREFERRED EMBODIMENTS

Figure 1:
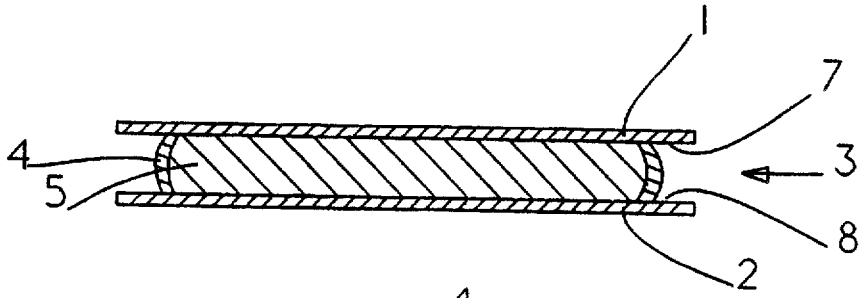
FIG. 1 illustrates a side-view, cross-section of a slice of bread between the two non-lossy, microwave-reflective plates of the kit.

FIG. 1 illustrates a side view of the two non-lossy members of a kit, where a first, flat, metal, microwave-reflective plate 1 and a second, flat, metal, microwave-reflective plate 2 sandwich a bread slice 3 there between. Bread slice 3 has an outer crust 4 and a soft, baked dough 5 interior. Heating members 1 and 2 have food contacting surfaces 7 and 8.

Flat, metal, microwave-reflective plates 1 and 2 may be fabricated of thin sheets of aluminum, stainless steel, ceramic coated steel, or other metals or laminates suitable for contact with a cooking food. Preferably, the flat metal plates are made of aluminum coated with and anti stick plastic. An electrically-insulating, plastic or ceramic coating precludes undesirable arcing between the plate and adjacent metal surfaces. Preferably, the weight of the upper member should not crush a slice of white bread. Handle members (not shown) may be provided.

Depending on the moisture content of the food, some may prefer to employ slightly lossy metal while others may prefer non-magnetic, non-lossy microwave-reflective plates. Lossy metal, as iron, gets warm, when exposed to microwave energy. The warmer the metal plates the higher the dew point and the less moisture accumulates on the metal plates. Some may prefer non-lossy metal so that the moisture condensing thereupon can be recovered to the heated bread by sliding the bread slice off of the metal plate rather than lifting it off.

Figure 3:
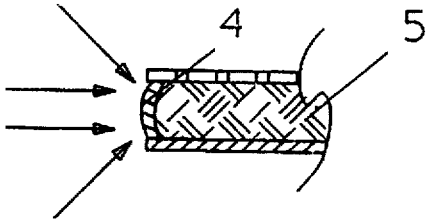
FIG. 3 illustrates a cut away section, of FIG. 1, that depicts the path microwave energy takes to enter the bread when the circumference of the bread slice and the circumference of the non-lossy, microwave reflective plates are the same.

In FIGS. 1 & 3, the desired result is microwave end-heating. The position, of the pair of non-lossy metal plates, in the microwave oven cavity, is not critical. The cook does not have to consider if the microwave oven is a top, a side, a bottom or a combination feed oven. Nor does the cook need to invert the apparatus.

In the present invention, the cook must consider the amount of liquid (e.g. freshness) present in the bread and the amount of this liquid that is will be driven off during the crusting and heating of a particular slice of bread. The cook must consider the initial temperature of the bread (e.g. whether or not the bread slices are frozen) and at what point to remove the metal plates prior serving the crusted bread. The type bread crust must be considered. Jewish rye bread has a hard crust and white bread has a soft crust. This invention permits a cook to either enhance the original crust or to arbitrarily change the taste and texture of the crust.

This microwave-oven, bread-crusting apparatus is a versatile cooking appliance in the hands of a practiced cook. There follows a list of types of products that have been successfully reconstituted in this microwave-oven apparatus: bread slices, bagels, and rolls; hot meat sandwiches; convenience French toast and waffles; and reconstituting large pretzels. This invention permits a cook to return yesterday's baked bread to its just-baked state. For example, a Jewish rye bread's hard crust, that has become soft, as a result of being packaged in a plastic package to sell in a supermarket, may be reconstituted to its just baked state.

Figure 2:
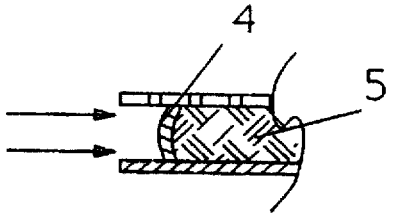
FIG. 2 illustrates a cut away section, of FIG. 1, that depicts the path microwave energy takes to enter the bread.

To accommodate a large number of bread shapes, preferably, the shape, of the metal plates, of the present apparatus, are rectangular and larger than the largest slice of bread the cook may encounter. In FIG. 2, when the plates are large and are not fabricated to duplicate the shape of a particular bread slice, microwave-energy strikes the bread crust parallel to the microwave-reflective plates.

Figure 5:
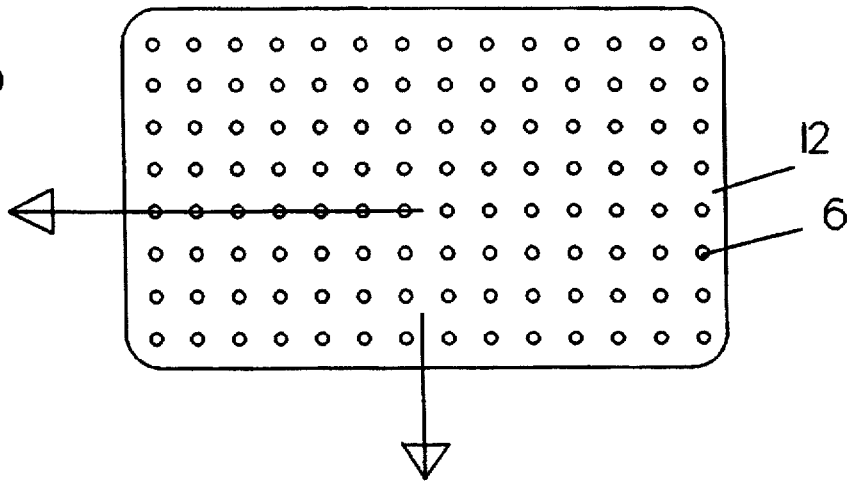
FIG. 5 illustrates a top view of one embodiment, of the non-lossy, microwave-reflective plates of FIG. 6.
Figure 6:
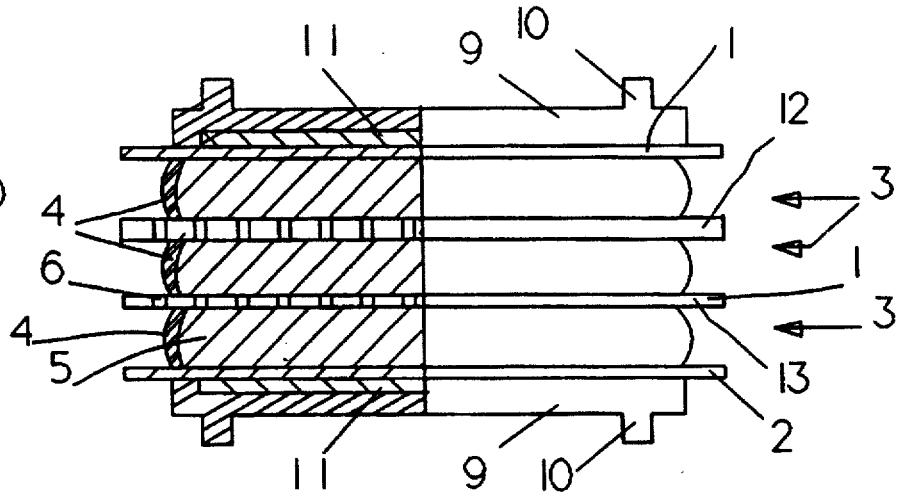
FIG. 6 illustrates how the two non-lossy members, of FIG. 1, are employed in combination with the two lossy heating members, of FIG. 4, to process three slices of bread.
Figure 7:
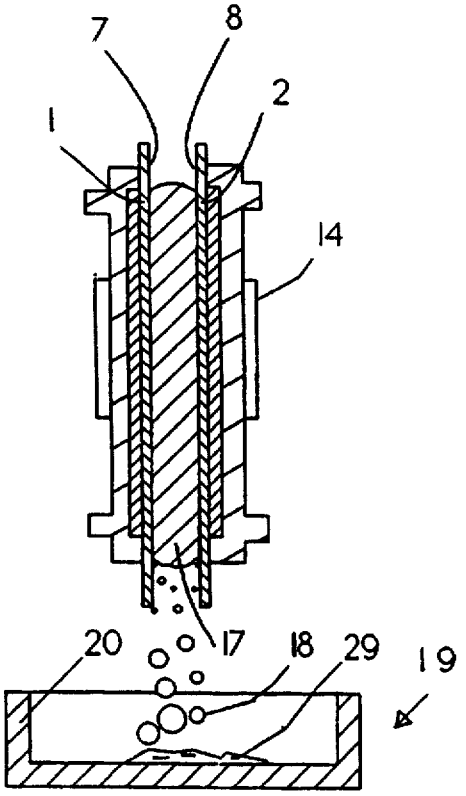
FIG. 7 illustrates the assembled apparatus, of FIG. 4, held vertically and compressed with kitchen tongs to squeeze liquid by-products into a collection container.
Figure 8:
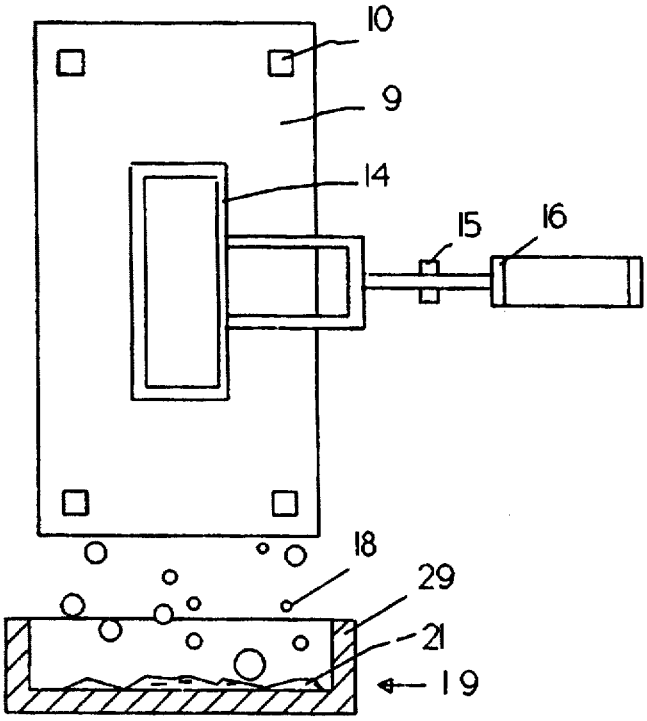
FIG. 8 is a side view of FIG. 7.

Selected shapes of the metal plates are useful. The bread crusting apparatus can be fabricated to duplicate the size and shape of a particular, recurring, bread crust configuration. In FIG. 3, when the flat, metal plates duplicate the shape of a particular bread slice, microwave-energy strikes the bread crust both parallel and at an angle to the microwave-reflective plates. The microwave energy hitting the crust from this added angle results in extra crusting. Representative cooking examples and procedures follow:

As seen in FIG. 1, solid metal plates 1 & 2 seal in what moisture is left in bread that has been stored for a day or so before being reconstituted by microwave energy. Those, that find just-baked, quick-frozen bread too wet, may choose to reconstitute this just-baked, quick-frozen bread between perforated metal plates 12, as seen in FIGS. 5 & 6. Perforations 6 facilitate the release, into the air, of unwanted moisture.

Some may desire to reclaim stale bread (e.g. bread sold after an expiration date or bread stored too long and that has become dry and hard). Bread that is dry and hard may be reconstituted and crusted by surface-defrost-wetting the bread before exposing it to microwave energy between the two metal plates. Surface-defrost-wetting is more fully described in U.S. Pat. No. 4,390,555, "Microwave Oven Cooking Method." With practice, a cook can reconstitute dry, hard bread (e.g. bread not considered fresh) to a state some have described as "fresher" and "crustier" than when the same bread was freshly baked.

Placed between two metal plates, bread slices are exposed to microwave energy for circa less than one minute per slice. When the heating and crusting process is over, the hot, non-lossy-metal plates may be employed to keep the center of the bread slice warm and moist for an extended time. When it is time to partake of the hot, moist, crusted bread slice, the apparatus is disassembled.

In FIG. 6, if a cook desires to prepare a stack of bread slices simultaneously, the cook may employ additional metal plates placed between individual slices or at every two slice interval.

Figure 4:
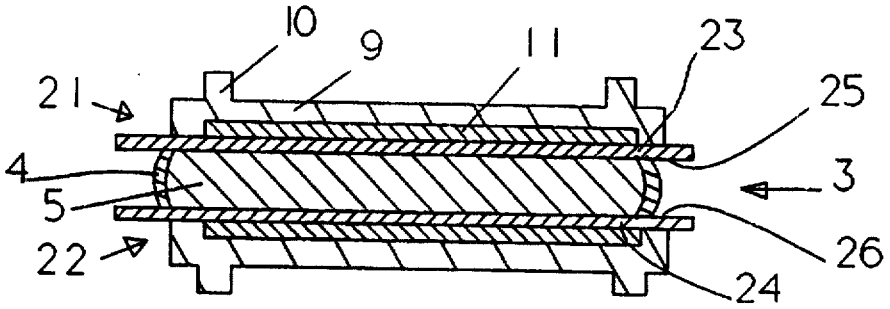
FIG. 4 illustrates a side-view, cross-section of a slice of bread between the two lossy, microwave-reflective plates of the kit.

FIG. 4 illustrates a side view of the two lossy members of the kit sandwiching a food there between. First food contacting surface 25, on first, metal grill plate 23 of first, microwave-absorptive, heating member 21, contacts the top of a slice of bread 3. Bread 3 rests in contact with a second food contacting surface 26 on second, metal grill plate 24 of a second, microwave-absorptive, heating member 22. In a well known manner both heating members 21 and 22 are shown with a microwave-lossy heating element 11 covered by a microwave-permeable covering 9 and optional feet 10.

In FIG. 4, when two, opposing, horizontal, heating members are exposed to microwave energy, in a top feed microwave oven, the upper, microwave-absorptive, heating member heats more rapidly than the lower, microwave-absorptive heating member. The reverse is true in a bottom feed microwave oven. So that both members receive similar exposures to microwave energy and thus heat equally, U.S. Pat. No. 5,045,660 teaches, when cooking, to invert the opposing heating member assembly at least once.

Figure 9:
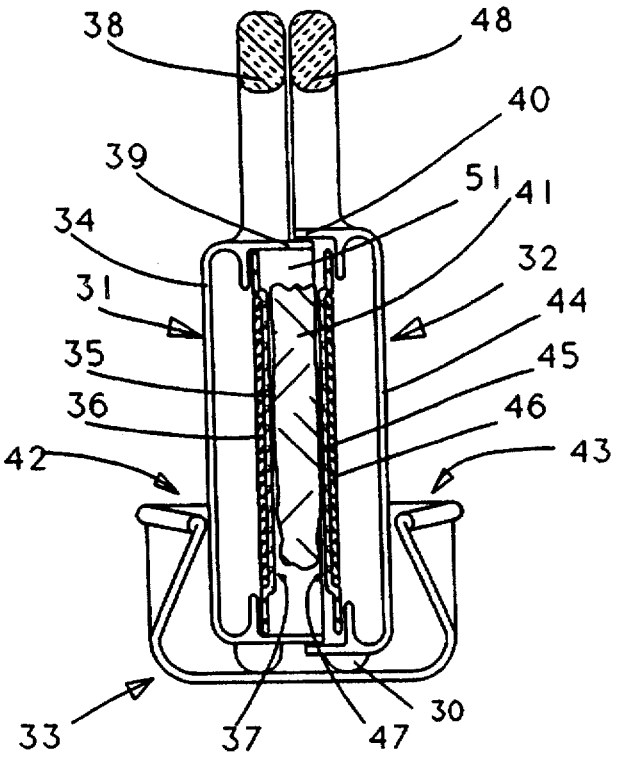
FIG. 9 illustrates another embodiment of the assembled two microwave-lossy, heating members held vertically and compressed together by the elastic walls of a liquid, by-product collection container
Figure 10:
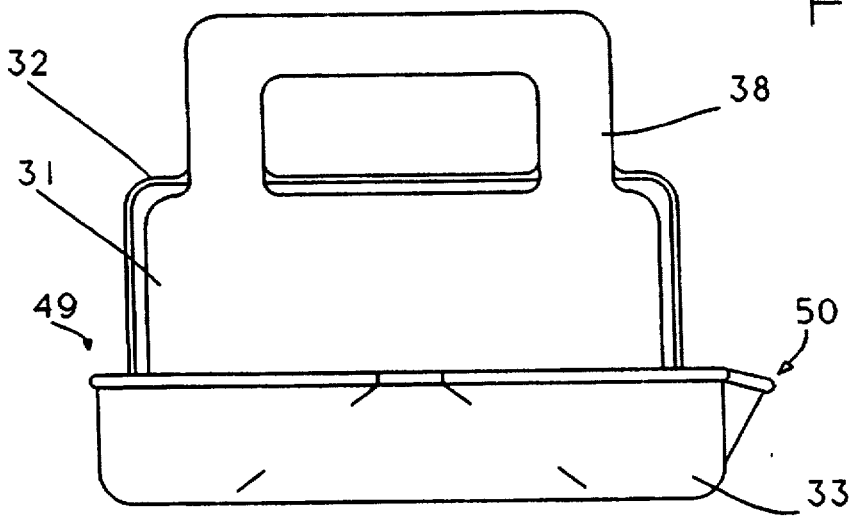
FIG. 10 is a side view, of FIG. 9, rotated 90 degrees.
Figure 11:
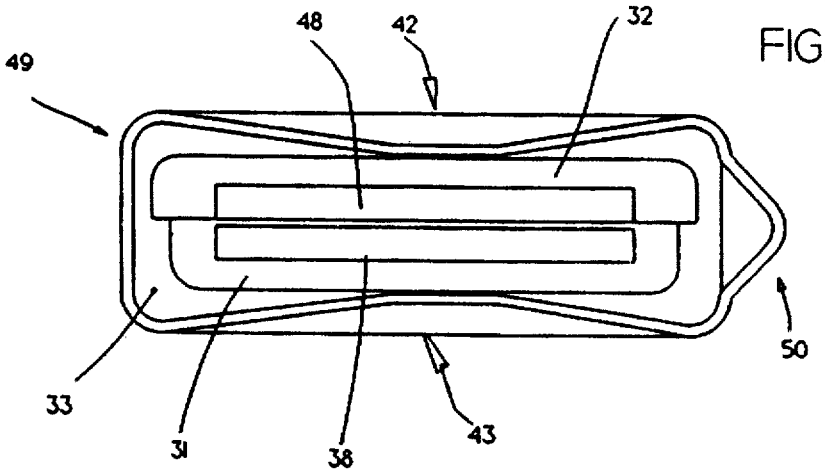
FIG. 11 is a top view of FIG. 9.

In FIG. 9, in a well known manner, microwave-absorptive heating member 31 has a high-temperature, microwave-permeable case 39 supporting the periphery of a metal grill 35. Heating member 31 has a food contacting surface 37, a microwave-absorptive heating element 36 in thermal contact with a reverse side of metal grill 35, and a heat-insulating handle 38. Heating member 32 is similar to heating member 31 in that it has a case 44, a grill 45, a food contacting surface 47, a heating element 46 and a handle 48.

As illustrated, heating members 31 and 32 differ in that the first microwave-absorptive heating member 31 has an inner aligning structure 39 that mates with an outer aligning structure 40 located on second microwave-absorptive heating member 32. In operation, aligning structures 39 and 40 engage and prevent relative side to side movement of heating members 31 and 32.

Figure 12:
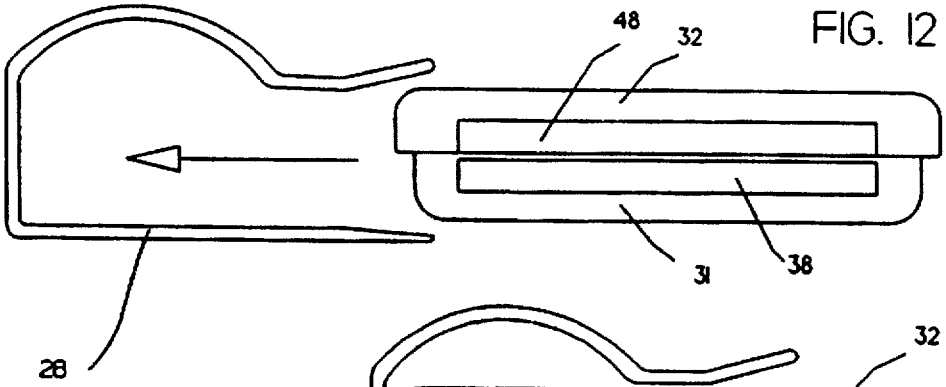
FIG. 12 & 13 illustrates how the two heating members can be held together by an elastic clamp.
Figure 13:
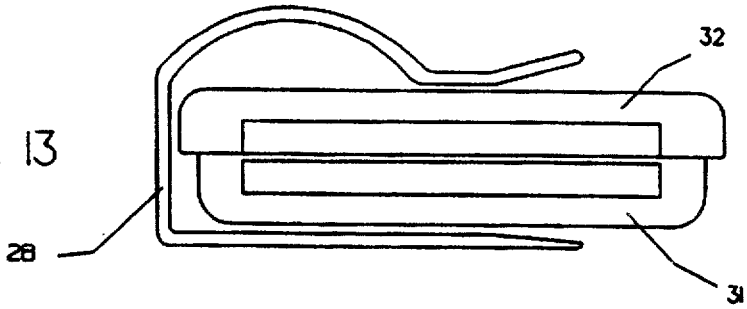

As seen in FIGS. 12 & 13, the elastic means to hold the microwave-absorptive heating member 31 to the second microwave-absorptive heating member 32 can be an elastic clamp 28.

Figure 14:
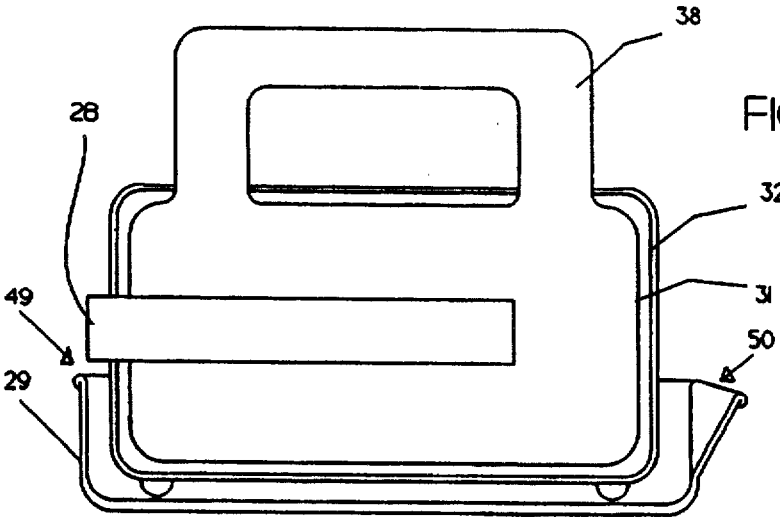
FIG. 14 illustrates a side view of the vertical cooking apparatus, of FIG. 13, inside of a cut away portion of a liquid by-product collection container.

In the embodiments of this invention, illustrated in FIGS. 9 & 14, because the microwave-absorptive heating members are positioned vertically in the microwave oven cavity, both members receive similar exposures to microwave energy simultaneously. In FIGS. 9 & 14, the cook no longer has to consider if the microwave oven is a top, a side, a bottom or a combination-feed oven. The cook does not have to decide how many times, during a cooking procedure, to invert the apparatus to allow both sides to cook equally.

When using a horizontal cooking apparatus, the cook has to consider the amount of liquid by-products that are released from a particular cooking food, because, the disproportionate amount of liquid by-products, falling onto the lower heating member, cools it faster then the amount reaching the upper heating member. In the present "Vertical Microwave-Oven Oven," illustrated in FIG. 9, this undesirable disproportionate cooling is not present.

Handle members 38, 48 are placed in juxtaposition and designed to permit the cook to lift, shake, invert and carry the assembled apparatus as a unit.

This apparatus, that may be called a "Vertical, Microwave-oven Oven" is a very versatile cooking appliance in the hands of a practiced cook. There follows a list of foods that have been successfully prepared in this vertical, microwave-oven apparatus: meats as steaks, lamb chops, chicken, and spare ribs; toasting bread, bagels, and rolls; corn beef hash; different cuts and types of French fried potatoes; convenience French toast and waffles; meat patties; hot dogs and hot dog rolls; pancakes; "pizza pie" sandwiches; and reconstituting large pretzels. Representative cooking examples and procedures follow:

Meat: The apparatus assembled, as shown in FIGS. 4 and 7 to 14, is useful for cooking either defrosted or frozen flat meat portions, as steaks and hamburgers. The vertical apparatus is preheated empty to a predetermined temperature (circa 500 degrees F.) by exposing it to microwave energy in a microwave oven. Whereupon, the vertical apparatus is removed from the microwave oven and food 41 is placed in a cooking area between two microwave-absorptive heating members.

In FIGS. 9 to 14, members 31 & 32, with food 41 there between, are first inserted into the wide receiving end 49 of collection chamber 33 and then pushed between elastic elements 42 and 43, of collection chamber 33, forcing the elastic structure apart. Forced apart the elastic members exert pressure on the heating members so that they clamp and squeeze the food 41 contained there between. The assembled vertical-cooking apparatus is returned to the microwave oven and exposed to microwave energy until food 41 heats to a desired serving temperature. Thereupon, the vertical apparatus is removed from the microwave oven and disassembled. Collected by-products are spilled out of the pouring end 50 of the collection chamber 33.

This apparatus is useful for defrosting, heating and cooking frozen meats, as hamburgers and steaks. For certain bulky and/or frozen foods, as a frozen fried chicken part, one may prefer to employ the heating members of this kit as taught in U.S. Pat. No. 5,094,865.

Toasted Bagels: The vertical apparatus is useful to prepare toasted bagels. First the vertical apparatus is preheated empty. Next a frozen, convenience bagel is placed in the vertical apparatus. The assembly is exposed to microwave energy until the bagel defrosts and the bagel's crust, additionally, bakes (e.g. browns). Then the bagel is removed. Thereafter, if desired, the bagel may be cut open and placed, crust to crust, back within the vertical apparatus.

Whereupon, the vertical apparatus is again exposed to microwave energy until the inside surfaces of the bagel, now in contact with the two hot grills, are toasted. Some may prefer these microwave-toasted-bagels to bagels toasted in a conventional toaster. In the rectangular grill illustrated, two bagel, side by side, may be toasted, simultaneously.

In FIG. 6, three bread slices 3 are placed between two opposing microwave-absorptive heating members. Two flat microwave-reflective member 12 & 13 are placed as shown between the bread slices. The two heating members and the three slices of bread, with said microwave-reflective member there between, are exposed to microwave energy for a predetermined time. The cooked bread slices are removed and used to prepare a triple decker sandwich. If the microwave heating members were preheated empty, after reconstituting, just the upper and lower surfaces of the bread stack are toasted.

Because the crusting, of all three bread slices, is enhanced and the top and bottom surface of the bread stack is toasted, some may consider the need to toast the four bread slice surfaces, that were not toasted, unnecessary.

General Comments:

1. Conventional, deep-fat frying results can be simulated by applying a small quantity of cooking oil to a frozen, convenience-type, pre-fried food, as French fried potatoes, to replace some of the oil that may be driven off during the microwave defrosting and heating.

2. A rectangular shaped heating member is preferable when cooking steaks and elongated foods as hot dogs and sausages.

3. The vertical apparatus has been described as a general-purpose, heating apparatus. Notwithstanding, the vertical apparatus can be fabricated as a special purpose "barbecue" apparatus, for example, the two food contacting surfaces may have embossed, on their surfaces, a matching grill structure to brand grill lines on a seared steak.

4. When the cooking process is over, the closed, vertical apparatus may be employed as a heat-retaining serving utensil to keep food warm for an extended time. After cooking, the apparatus is left assembled. When it is time to partake of the still hot, cooked food, the vertical apparatus is opened. Thereupon, if desired, the two microwave-absorptive heating members may be employed as individual sizzling hot, serving dishes. Collection chamber 33 may be employed as a gravy boat.

5. An advantage to clamping meat between the cooking surfaces vertically is that smoke is reduced or eliminated from the browning and seating process. It is believed that, because the browning results from contact heating, oxygen from the air cannot reach the browning food surface and cause smoke (e.g., incomplete combustion).

Although this invention has been described with a certain degree of particularity, it is understood that the present disclosure has been made only by way of example and that numerous changes in details of construction and arrangement of parts may be resorted to without departing from the spirit and scope of the invention.

I claim:

1. A method to edge-heat and crust bread slices, in a microwave oven, that includes the steps of:

placing, at least one, slice of bread between a first, microwave-reflective member that has a first, food-contacting surface to shield the full top of said bread slice in contact therewith and a second, microwave-reflective member that has a second food-contacting surface to shield the full bottom surface of said bread slice in contact therewith, and exposing the assembly to microwave energy in said microwave oven for a predetermined time.

2. A method to edge-heat and crust bread slices, in a microwave oven, according to claim 1, that includes the step of:

where the bread is dry adding water to the bread before exposing it to microwave energy in said microwave oven.

3. A method to edge-heat and crust bread slices, in a microwave oven, according to claim 1, that includes:

where, at least, one of said microwave-reflective members is perforated.

4. A method to edge-heat and crust bread slices, in a microwave oven, according to claim 1, that includes:

where the circumference of said microwave reflective members are fabricated to duplicate the circumference of said slice of bread.

5. A method of cooking a basically-flat food, in a microwave oven, that includes the steps of:

placing said food between two opposing cooking surfaces located on two opposing microwave-absorptive heating members, exposing to microwave energy said heating members and said food for in said microwave oven a predetermined time, after employing means to secure and rotate said two cooking members with said food there between into a vertical position, and while in said vertical position, employing means to compress together said cooking members to drain and squeeze out liquid by-products from said food.

6. A method of cooking a basically-flat food, in a microwave oven, according to claim 5, that includes:

collecting said liquid by-products in a microwave-reflective collector means designed to limit the exposure of said by-products to microwave energy.

7. A method of cooking a basically-flat food, in a microwave oven, according to claim 5, that includes:

where said means to compress is an elastic means to clamp and squeeze said food between said cooking surfaces.

8. A method of cooking at least two basically-flat foods, in a microwave oven, that includes the steps of:

placing said two foods between two opposing cooking surfaces located on two opposing microwave-absorptive heating members, placing a basically-flat microwave-reflective member between said two foods, and exposing to microwave energy said heating members and said two foods with said microwave-reflective member there between in said microwave oven for a predetermined time.

9. A microwave-oven, cooking kit that comprises:

a first microwave-absorptive heating member that has a first cooking surface fabricated to heat a first surface of a food in contact therewith, a second microwave-absorptive heating member that has a second cooking surface fabricated to heat a second surface of said food in contact therewith, means to secure and rotate said two cooking members with said food there between into a vertical position, means to compress said food to force therefrom liquid by-products when said food is located between said two microwave-absorptive heating members in said vertical position, and means to contain liquid by-products of said food, compressed and drained out of said food when said cooking surfaces are vertical.

* * * * *